US006112718A

United States Patent [19]

Bond

[11] Patent Number: 6,112,718

[45] Date of Patent: Sep. 5, 2000

[54] PRESSURE REGULATOR

[75] Inventor: Robert Stephen Bond, Challock, United Kingdom

[73] Assignee: Lucas Industries, Solihull, United Kingdom

[21] Appl. No.: 09/026,041

[22] Filed: Feb. 19, 1998

[30] Foreign Application Priority Data

Aug. 3, 1997 [GB] United Kingdom ..... 9704834

[51] Int. Cl.[7] ..... F02M 15/00

[52] U.S. Cl. ..... 123/310; 123/540

[58] Field of Search ..... 417/310, 540

[56] References Cited

U.S. PATENT DOCUMENTS

| | | | |
|---|---|---|---|
| 4,401,082 | 8/1983 | Leblanc | 123/447 |
| 4,440,134 | 4/1984 | Nakao et al. | 417/540 |
| 4,775,300 | 10/1988 | Knudsen | 417/310 |
| 5,372,484 | 12/1994 | Bridds et al. | 417/310 |
| 5,547,349 | 8/1996 | Kimura et al. | 417/310 |
| 5,759,013 | 6/1998 | Miyazaki et al. | 417/310 |
| 5,797,732 | 8/1998 | Watanabe et al. | 417/310 |

FOREIGN PATENT DOCUMENTS 0 711 914 A1 5/1996 European Pat. Off. .

*Primary Examiner*—John Kwon
*Attorney, Agent, or Firm*—Wells, St. John, Roberts, Gregory & Matkin, P.S.

[57] ABSTRACT

A pressure regulator for use with a low pressure fuel pump comprises a pressure relief valve connected between the inlet and outlet of the pump to permit fuel flow from the outlet to the inlet upon the pressure difference therebetween exceeding a predetermined level, and an accumulator independent of the pressure relief valve communicating with the outlet of the pump.

6 Claims, 2 Drawing Sheets

PRESSURE REGULATOR

This invention relates to a pressure regulator for use with a low pressure fuel pump.

Low pressure fuel pumps are used to supply fuel at relatively low pressure to the inlet of high pressure fuel pumps, and to other devices. It is usual to provide a pressure regulator across the inlet and outlet of the low pressure pump to control the pressure at which fuel is supplied by the low pressure pump.

FIG. 1 illustrates a conventional pressure regulator which comprises a piston 1 slidable within a bore 2, one end of the bore 2 being connected to the fuel inlet 3 of a low pressure rotary vane pump 4 whilst the other end of the bore 2 is connected to the fuel pump outlet 5. A spring 6 biases the piston 1 towards the outlet end of the bore 2. An opening 7 is provided in the bore 2 and located such that when the pressure at the pump outlet 5 exceeds that at the inlet 3 by more than a predetermined amount, the piston 1 moves against the action of the spring 6 to increase the rate of flow from the outlet 5 through the opening 7 to the inlet 3. Such large pressure differentials occur when the high pressure pump 8 is delivering fuel, no fuel being supplied to the high pressure pump 8 at this time, even though the pump 4 continues to operate. During a subsequent filling part of the high pressure pump's operating cycle, fuel is supplied to the high pressure pump 8 from the low pressure pump outlet 5, thus the pressure at the outlet 5 is reduced. The reduction in outlet pressure results in the pressure differential falling and the piston 1 moving to reduce the flow of fuel through the opening 7. The movement of the piston 1 is gradual as the pressure falls, and fuel continues to flow through the opening 7 even though, at this time, fuel is being supplied to the high pressure pump 8.

Where the volume of fuel required by the high pressure pump is high, and the time over which the fuel can be supplied is short, it is difficult to supply sufficient fuel to the high pressure pump. It is an object of the invention to provide a pressure regulator which enables this disadvantage to be reduced.

According to the present invention there is provided a pressure regulator comprising spring biased pressure relief valve arranged to be connected across the inlet and outlet of a low pressure pump, to permit fuel flow from the outlet to the inlet when the pressure difference therebetween exceeds a predetermined level, and an accumulator connected to the outlet, the accumulator being defined by a piston slidable within a cylinder, and a spring biasing the piston towards a position in which the volume of the accumulator exposed to fuel at the pump outlet pressure is low.

The spring of the accumulator and the parameters of the pressure relief valve are chosen to allow movement of the piston to increase the accumulator volume prior to the pressure relief valve opening. Upon the outlet pressure falling, fuel is supplied from the accumulator supplementing the supply directly from the fuel pump, the pressure relief valve closing rapidly as it is independent of the accumulator to terminate the return flow of fuel from the outlet to the inlet.

The invention will further be described, by way of example, with reference to the accompanying drawings, in which.

Figure 1:
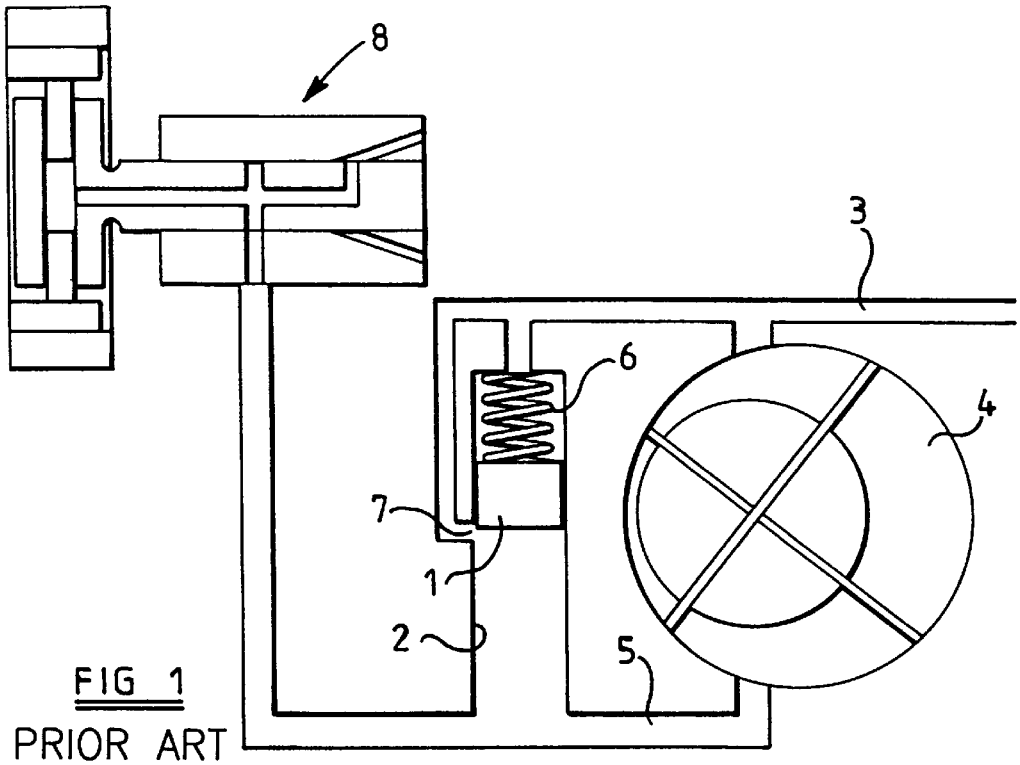
FIG 1 PRIOR ART
FIG. 1 is a diagrammatic view of a conventional pressure regulator in conjunction with low and high pressure pumps.
Figure 2:
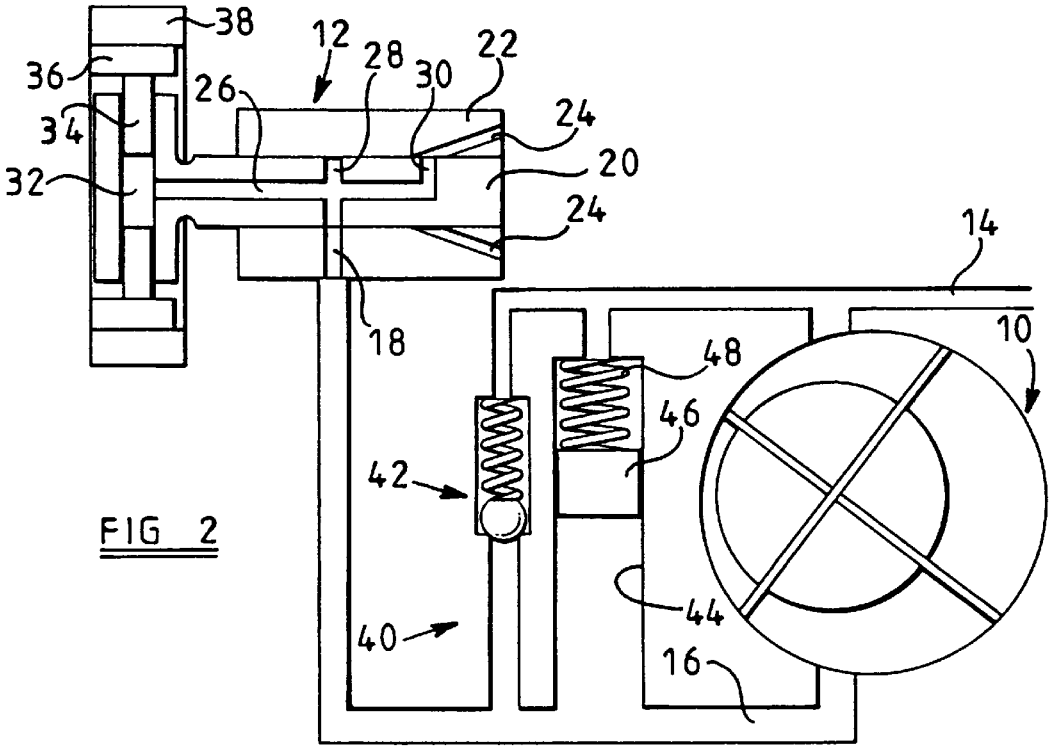
FIG. 2 is a view similar to FIG. 1 of a first embodiment of the invention.

The pressure regulator illustrated in FIG. 2 is intended for use in conjunction with a low pressure vane or gear pump 10 of substantially fixed output per revolution and a high pressure pump 12. The low pressure pump 10 includes an inlet 14 which is arranged to receive fuel from an appropriate fuel reservoir. The low pressure pump 10 also communicates through an outlet 16 with an inlet port 18 of the high pressure pump 12.

The high pressure pump comprises a distributor member 20 rotatable within a sleeve 22 within which the inlet port 18 and a plurality of outlet ports 24 are provided. The distributor member 20 includes an axially extending passage 26 and radially extending inlet and outlet passages 28, 30 which are arranged to register with the inlet and outlet ports 18, 24 upon rotation of the distributor member 20 with respect to the sleeve 22. The distributor member 20 includes an enlarged region within which a through bore 32 is provided, the bore 32 communicating with the axially extending passage 26. Pumping plungers 34 are reciprocable within the bore 32, the outer end of each plunger 34 engaging a shoe and roller arrangement 36 which cooperates with the cam surface of a cam ring 38 so that upon rotation of the distributor member 20, the plungers 34 reciprocate within the bore 32 under the influence of the cam surface.

Although the drawing illustrates the inlet and outlet passages 28, 30 in register with both the inlet and outlet ports 18, 24, in practice, the orientation of the passages and ports is such that when the inlet port 18 communicates with one of the inlet passages 28, the outlet passage 30 is not in communication with any of the outlet ports 24. In use, fuel from the outlet 16 of the low pressure pump 10 is supplied through the inlet port 18 and inlet passage 28 which communicates with the inlet port 18, the fuel being supplied to the bore 32 causing the plungers 34 to move radially outward. Rotation of the distributor member 20 results in the communication between the inlet passage 28 and inlet port 18 being broken, and in the outlet passage 30 communicating with one of the outlet ports 24. Once such a position has been achieved, the rollers of the shoe and roller arrangements 36 engage cam lobes provided on the cam surface of the cam ring 38 causing the plungers 34 to commence inward movement. The inward movement of the plungers 34 compresses the fuel within the bore 32 causing fuel to be delivered at high pressure from the bore 32 to the outlet port 24 which is in communication with the outlet passage 30. Continued rotation results in the rollers riding over the cam lobes of the cam ring 38 thus inward movement of the plungers 34 terminates. Subsequently, the outlet passage 30 moves out of communication with the outlet port 24, and eventually the next inlet passage 28 registers with the inlet port 18 ready for commencement of the next pumping cycle.

Although not illustrated, the distributor member 20 is driven at a speed associated with the operating speed of an associated engine through an appropriate drive shaft. Further, rather than delivery terminating as a result of the plungers commencing outward movement, the pump 12 may be of the spill type.

In order to control the fuel pressure at the outlet 16 of the low pressure pump 10, a pressure regulator 40 is connected between the outlet 16 and inlet 14. The pressure regulator 40 comprises a spring biased pressure relief valve 42 which is normally closed, but is arranged to open to permit fuel to flow from the outlet 16 to the inlet 14 upon the pressure difference between the outlet 16 and inlet 14 exceeding a predetermined pressure difference. The pressure regulator 40 further comprises an accumulator defined by a bore 44 interconnecting the outlet 16 and inlet 14, a piston 46 being slidable within the bore 44 against the action of a spring 48. The rate of the spring 48 is selected to permit movement of the piston 46 to increase the volume of the accumulator exposed to the pressure at the outlet 16 of the low pressure pump 10 prior to the pressure relief valve 42 opening. The pressure at which the pressure relief valve 42 opens is dependent upon its seating diameter and the rate of its spring. The seating diameter of the pressure relief valve 42 is conveniently large in order to increase the sensitivity of the pressure relief valve 42 to pressure changes. When the high pressure pump 12 is delivering fuel at high pressure, and is not receiving any fuel from the low pressure pump 10, the fuel pressure within the outlet 16 increases, and the increase in pressure is sufficient to move the piston 46 against the action of the spring 48, thus a relatively large volume of fuel is provided between the low pressure pump 10 and high pressure pump 12. Should the fuel pressure within this volume exceed the pressure at which the pressure relief valve 42 opens, the valve 42 will open to permit fuel to flow from the outlet 16 to the inlet 14.

During a subsequent filling part of the operating cycle of the high pressure pump 12, fuel from the outlet 16 is supplied to the high pressure pump 12, the fuel supply from the low pressure pump 10 being supplemented by fuel from the accumulator, the piston 46 moving under the action of the spring 48 to expel fuel from the bore 44. It will be appreciated that as the fuel supply to the high pressure pump 12 is from the accumulator as well as from the low pressure pump 10, the rate of fuel supply to the high pressure pump 12 exceeds the rate at which fuel is supplied by the low pressure pump 10. If the pressure relief valve 42 were open, the reduction in pressure applied thereto resulting from the supply of fuel to the high pressure pump 12 causes the pressure relief valve 42 to close rapidly minimising the quantity of fuel returned to the inlet 14 through the pressure relief valve 42.

Figure 3:
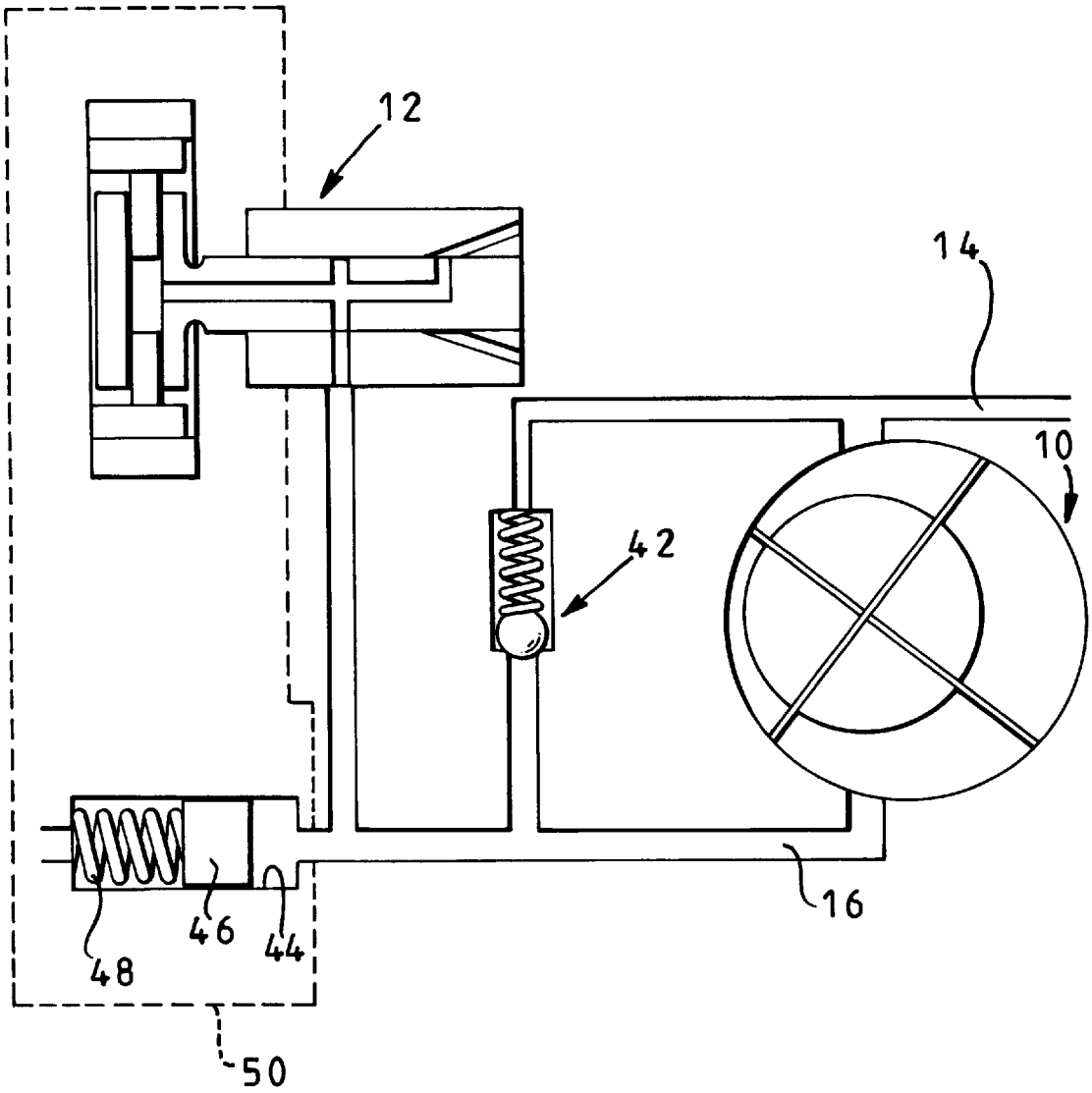
FIG. 3 is a view of an alternative embodiment.

The arrangement illustrated in FIG. 3 is similar to that of FIG. 2 with the exception that the accumulator of the pressure regulator 40 is not connected between the outlet 16 and inlet 14, and instead the accumulator is connected between the outlet 16 and the cam box (denoted by dashed line 50) which houses the cam ring 38 of the high pressure fuel pump 12. Operation of this embodiment is similar to that described with reference to FIG. 2 with the exception that movement of the piston 46 against the action of the spring 48 results in fuel displacement from the bore 44 to the cam box 50 of the high pressure pump 12 rather than to the inlet 14 of the low pressure pump 10 as occurs in the arrangement of FIG. 2. Such an arrangement is advantageous in that, in use, outward movement of the plungers of the high pressure pump 12 increases the fuel pressure within the cam box 50. In the arrangement of FIG. 3, the movement of the piston 46 during this stage of the pumping cycle allows fuel to flow into the bore 44 thus reducing the level of cam box pressure increase, and assisting the spring 48.

What is claimed is:

1. A pressure regulator for use with a low pressure pump having an inlet and an outlet for fuel, the pressure regulator comprising a spring biased pressure relief valve arranged to be connected across the inlet and outlet of the pump to permit fuel flow from the outlet to the inlet when the pressure difference therebetween exceeds a predetermined level, and an accumulator connected to the outlet of the pump, the accumulator being defined by a piston slidable within a bore, the piston being biased towards a position in which the volume of the accumulator exposed to fuel at the pump outlet pressure is low.

2. A pressure regulator as claimed in claim 1, wherein the piston is biased by a spring.

3. A pressure regulator as claimed in claim 1, wherein the pressure relief valve comprises a spherical valve member spring biased towards a seating.

4. A pressure regulator as claimed in claim 3, wherein the seating is of large diameter.

5. A pressure regulator for use with a low pressure pump having an inlet and an outlet for fuel, the pressure regulator comprising a spring biased pressure relief valve arranged to be connected across the inlet and outlet of the pump to permit fuel flow from the outlet to the inlet when the pressure difference therebetween exceeds a predetermined level, and an accumulator connected to the outlet of the pump, the accumulator being defined by a piston slidable within a bore, the piston being biased towards a position in which the volume of the accumulator exposed to fuel at the pump outlet pressure is low, and the piston includes a rear surface exposed to the fuel pressure at the inlet of the pump.

6. A pressure regulator for use with a low pressure pump having an inlet and an outlet for fuel, the pressure regulator comprising a spring biased pressure relief valve arranged to be connected across the inlet and outlet of the pump to permit fuel flow from the outlet to the inlet when the pressure difference therebetween exceeds a predetermined level, and an accumulator connected to the outlet of the pump, the accumulator being defined by a piston slidable within a bore, the piston being biased towards a position in which the volume of the accumulator exposed to fuel at the pump outlet pressure is low, and the piston includes a rear surface exposed to the fuel pressure within a cam box of an associated high pressure fuel pump.

* * * * *